US006668687B1

(12) United States Patent
Miller

(10) Patent No.: US 6,668,687 B1
(45) Date of Patent: Dec. 30, 2003

(54) MULTI-FUNCTIONAL SCREWDRIVER

(76) Inventor: Charles H. Miller, 128 N. Lakeview Dr., Lake Helen, FL (US) 32744

( * ) Notice: Subject to any disclaimer, the term of this patent is extended or adjusted under 35 U.S.C. 154(b) by 14 days.

(21) Appl. No.: 10/189,426

(22) Filed: Jul. 8, 2002

(51) Int. Cl.[7] ..... B25B 13/00
(52) U.S. Cl. ..... 81/73; 81/35
(58) Field of Search ..... 81/35, 73

(56) References Cited

U.S. PATENT DOCUMENTS 5,349,886 A * 9/1994 Jin ..... 81/73

* cited by examiner

*Primary Examiner*—James G. Smith
(74) *Attorney, Agent, or Firm*—Breiner & Breiner, L.L.C.

(57) ABSTRACT

The invention relates to a multi-functional screwdriver including a shaft forming a pair of coplanar bends rotatably mounted to a handle having therein a compartment for storing a plurality of bits. The shaft is covered with a non conductive sleeve and includes a magnetic bit driver on a distal end for securing bits. To prevent rotation of the shaft within the handle a locking means is provided which includes a locking member pivotally attached to the handle which can be pivoted so that the member is removably inserted into an aperture in the shaft to prevent the shaft from rotating within the handle.

18 Claims, 1 Drawing Sheet

MULTI-FUNCTIONAL SCREWDRIVER

FIELD OF THE INVENTION

The invention relates to a multi-functional hand-tool, and more particularly, to a screwdriver for driving fasteners such as screws, bolts and the like. The screw-driver includes an offset shaft having at one end a means of engaging and retaining therein a bit and at an end opposite thereto a handle adapted to rotate relative to the shaft. A locking means pivotally attached to the handle is provided which is arranged to removably engage the shaft to prevent rotation of the handle.

BACKGROUND OF THE INVENTION

When inserting or removing a fastener with a hand tool into or from a work surface, a workman's efficiency is limited by the ability of the tool to translate mechanical force exerted by his hand to the fastener through rotary movement. For example, a tool such as a conventional screw-driver having a fixed handle mounted to a straight shaft imposes a physical limitation on the workman, allowing him to utilize only the torque which he can exert through his hand by the twisting of his wrist. Additionally, because the wrist cannot rotate completely about a circle, to complete a cycle of rotation with a conventional hand tool, the workman must periodically release his grip on the handle of the tool, rotate his hand back to a starting position and re-grip the tool handle to continue applying force.

Attempts have been made to provide rotary tools permitting better translation of the workman's exertions. For example, U.S. Pat. No. 5,349,886 to Jin discloses a hand screwdriver including a freely rotatable handle and a bent shaft having an end recess which selectively bears against one of two conical protrusions within the handle. The conical protrusions provide a fixed position wherein the shaft is fixed to the handle and a rotatable position wherein the shaft is relatively rotated with respect to the handle. The screwdriver further includes a protective coating about the upper portion of the shaft adjacent to the handle for protecting a workman from electrical shock. A shortcoming of Jin is that no means is provided for preventing rotation of the handle relative to the shaft. As such, a workman cannot impart sufficient torque to a fastener when using the screwdriver of Jin to break the fastener loose from a work surface when tightly held therein. Likewise, a workman cannot provide sufficient torque to a fastener to tightly insert it into the work surface. A further shortcoming of Jin is that the protective coating about the shaft fails to envelop the entire shaft thereby needlessly exposing a workman to electrical shock from the unprotected portions of the shaft.

U.S. Pat. No. 1,642,569 to Winslow et al discloses a hand tool including a bent shaft having a handle rotatably attached to an end thereof. Contrary to Jin, a pressure plate is slidably mounted within the handle which slips through a slot therein and is bearable against the handle, selectively fixing the handle to the shaft. This way, a workman can impart increased torque to a fastener than if the handle and shaft were not fixable together. The screwdriver of Winslow et al however provides no suitable means of disengaging the pressure plate from the shaft. For example, a workman attempting to grip the pressure plate while wearing gloves to pull the plate out of the slot will have great difficulty doing so.

Therefore, despite the teachings of the prior art, a need still exists for a hand-powered tool which facilitates the translation of rotary motion from a workman's hand to a fastener through a freely rotating angled shaft while providing practical means of preventing rotation of the shaft when needed. The present invention overcomes the shortcomings of the prior art and additionally provides a novel combination of hand-tool accessories with the multi-functional screwdriver of the present invention.

SUMMARY OF THE INVENTION

It is a primary object of the invention to provide a multi-functional screwdriver having an offset shaft rotatably connected to a handle wherein the shaft can be releaseably fixed to the handle to prevent rotation of the shaft relative to the handle.

It is a further primary object of the invention to provide a multi-functional screwdriver including an offset shaft rotatably mounted to a handle wherein the shaft can be releaseably fixed to the handle to prevent rotation of the. shaft relative to the handle and wherein the shaft is covered in its entirety with a non-conductive material.

It is a further primary object of the invention to provide a multi-functional screwdriver including an offset shaft rotatably mounted to a handle wherein the shaft can be releaseably fixed to the handle to prevent rotation of the shaft relative to the handle and wherein the shaft is magnetic.

It is a further primary object of the invention to provide a multi-functional screwdriver including an offset shaft rotatably mounted to a handle wherein the shaft can be releaseably fixed to the handle to prevent rotation of the shaft relative to the handle and wherein the handle includes a compartment for storing a plurality of bits.

It is a further primary object of the invention to provide a multi-functional screwdriver having an offset magnetic shaft covered in its entirety by a non-conductive sleeve, the shaft being rotatably mounted to a handle wherein a L-shaped locking member is pivotally attached to the handle which is releaseably engageable with the shaft to prevent rotation of the handle relative to the shaft and wherein the handle includes a compartment for storing a plurality of bits.

The screwdriver of the present invention comprises an offset shaft having two co-planer bends therein thus providing the shaft with a relaxed Z-shape; a handle having a resealable compartment for storing a plurality of bits, the handle being rotatably mounted to the shaft; a non-conductive sleeve circumposed about an entire length of the shaft; a magnetic bit driver connected at an end of the shaft opposite the handle; and a means of locking the shaft to the handle to prevent rotation of the handle relative to the shaft.

More particularly, the locking means of the invention includes a base fixed to the handle and a substantially L-shaped locking member connected to the base by a pin or hinge so that the locking member and base form a lever and fulcrum, respectively. An opening, hole or groove in the shaft which is adapted to receive an end of the locking member is provided which allows the workman to fix or unfix the shaft to the handle by pivoting the locking member either toward the shaft to prevent rotation of the handle relative to the shaft or toward the handle to prevent the rotation.

Preferably, the locking means includes the locking member as described above pivotable on a pin located within a depression within the handle. The depression conforms to the shape of the locking member and is long enough to accept the entire portion of the locking member that is adjacent to the handle when the locking member is pressed there against. The depression includes means of snapping or securing the locking member therein when the locking member is not engaged with the shaft. This way, the locking member, in part, can be securely held within the handle when the handle and shaft are in an unlocked position. Snapping means can include, for example, a ball and detent system or simply a portion of the depression having decreased width which allows the locking member to fit snugly therein.

Though it is preferred that the locking member comprise a substantially L-shape, it is anticipated that various modifications of the locking member can be made. For example, the locking member can include a rectangular member having rounded edges which conform the shape of the locking member to the handle and/or shaft to provide a more ergonomic design. The locking means therefore may be any fulcrum and lever system that allows the lever to engage the shaft, for example, at the opening or groove therein, thereby fixing the shaft to the handle.

BRIEF DESCRIPTION OF THE DRAWINGS

Other objects, advantages and novel features of the present invention will be apparent from the following detailed description of the invention when considered in conjunction with the accompanying drawings, in which like reference numerals designate like parts throughout the figures thereof, and wherein.

DETAILED DESCRIPTION AND PRESENTLY PREFERRED EMBODIMENTS

Figures 1, 2, 3, 4:
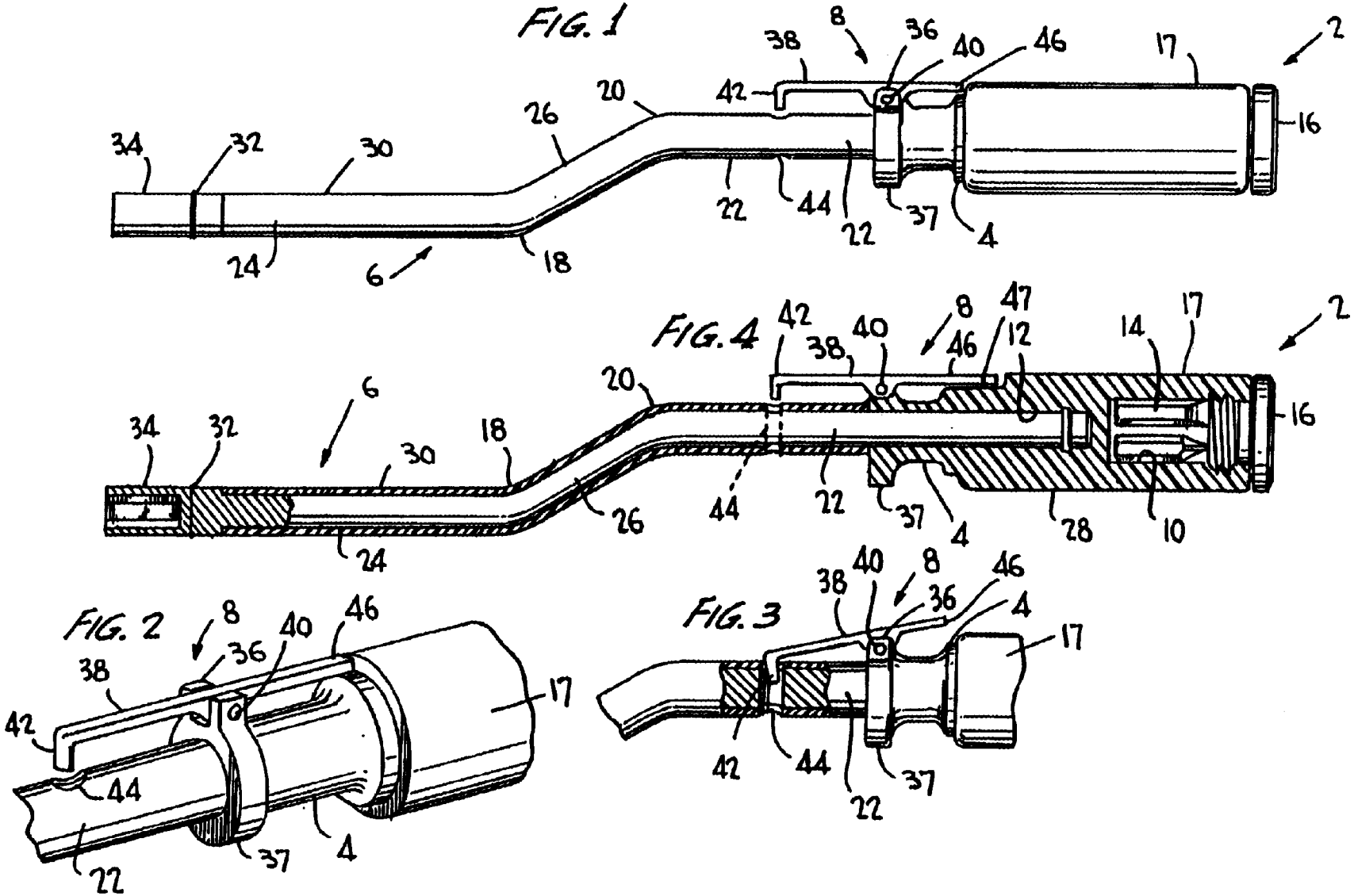
FIG. 1 is a side plan view of a multi-functional screwdriver in an un-unlocked position in accordance with a preferred embodiment of the present invention.
FIG. 2 is a partial perspective view of the multi-functional screwdriver of FIG. 1.
FIG. 3 is a partial cross-sectional side view of the multi-functional screwdriver of FIG. 1 in a locked position.
FIG. 4 is a cross sectional side view of a multi-functional screwdriver in an un-unlocked position in accordance with another preferred embodiment of the present invention.

A preferred embodiment of an improved multi-functional screwdriver 2 and parts thereof for inserting fasteners such as screws and bolts into a workpiece are illustrated in FIGS. 1, 2 and 3. Another preferred embodiment of screwdriver 2 and parts thereof are illustrated in FIG. 4. Screwdriver 2 generally includes a handle 4, an offset or bent shaft 6 rotatably mounted to handle 4 and a locking means 8 pivotally attached to handle 4 for effectively preventing rotation of handle 4 about shaft 6.

Handle 4 is an essentially cylindrical shaped member constructed of any suitable material such as high-impact plastic or wood. A pair of open-ended, opposing compartments 10 and 12 are formed within handle 4 for providing a location for storage of a plurality of bits 14 and for rotatably engaging shaft 6, respectively. A lid 16 is provided to resealably enclose compartment 10 containing bits 14. To allow a worker to better hold the screw-driver a grip 17 is included about handle 4.

As illustrated in FIGS. 1 and 4, shaft 6 forms a pair of coplanar bends 18 and 20 which give shaft 6 a relaxed Z-shape making shaft 6 offset relative to handle 4. This way, shaft 6 when engaged with a fastener can be rotated within handle 4 to, in turn, rotate the fastener. Bends 18 and 20 define three distinct sections of shaft 6, namely an upper section 22, a lower section 24 and a middle section 26. Upper section 22 of shaft 6 is rotatably mounted within compartment 12 of handle 4. A rotating means 28 allows for rotation of shaft 6 within handle 4 and can be any suitable means known in the art, for example, as disclosed in U.S. Pat. No. 5,706,709 to Snow, U.S. Pat. No. 1,642,569 to Winslow et al or U.S. Pat. No. 4,974,477 to Anderson. Positioned at an end 32 of lower section 24, a bit driver 34 is provided for retaining one of the plurality of bits 14. Bit driver 34 is preferably magnetic and attached at end 32 by welding and the like or a ball and detent mechanism so that bit driver 34 is interchangeable. Shaft 6 is constructed of any suitable metal, preferably, a metal capable of being magnetized so that bits 14 and/or fasteners are held thereagainst for easy loading of shaft 6.

To protect a workman from electrical shock when using the present invention, shaft 6 is covered throughout its length with a sleeve 30 constructed of any durable non-conductive material or composite. Sleeve 30 may cover only a portion of shaft 6, for example, upper section 22, but doing so exposes a workman to an easily preventable risk. Suitable materials for sleeve 30 include, for example, plastic, rubber and woven or non-woven cloth and should have a strength and thickness to prevent punctures or tears of sleeve 30.

As illustrated in FIGS. 1, 2 and 3, locking means 8 of the embodiment therein includes a base 36 mounted onto handle 4 at an end 37 opposite compartment 10. Base 36 includes a pair of opposing, substantially parallel faces (not shown) and provides a support on which a substantially L-shaped locking member 38 can be pivotally mounted thereto by a pin 40 which extends through locking member 38 and the parallel faces of base 36. This way, base 36, in conjunction with pin 40, serve as a fulcrum and locking member 38 as a lever which pivots on pin 40.

Locking member 38 includes a first portion 42 which extends from the intersection of pin 40 with locking member 38 out over and adjacent to upper section 22 of shaft 6. As illustrated in FIG. 3, first portion 42 is adapted to be pivoted downward when pressure is applied thereagainst by the hand of a workman to insert first portion 42 through an aperture 44 in upper section 22. Aperture 44 can be a groove or indentation, but to securely retain first portion 42 therein, an aperture is preferred. When first portion 42 is actuated into aperture 44, shaft 6 cannot be rotated within compartment 12 of handle 4. As such, a workman can impart torque to shaft 6, as if shaft 6 and handle 4 where integral, in a greater amount than if handle 4 and shaft 6 were rotatable relative to one another.

Opposite first portion 42 of locking member 38 is a second portion 46 which extends from the intersection of locking member 38 with pin 40 out over and adjacent to handle 4. Second portion 46 is adapted to receive pressure from the hand of a workman to pivot portion 46 toward and ultimately against handle.4 in order to disengage first portion 42 from aperture 44 of upper section 22. In this unlocked position, as illustrated in FIGS. 1 and 2, shaft 6 is allowed to rotate within compartment 12 of shaft 4 to allow a workman to more quickly and efficiently insert or remove a fastener than if handle 4 and shaft 6 were not rotatable relative to one another.

Locking means 8 of the embodiment illustrated in FIG. 4 replaces base 36 of the embodiment of FIGS. 1 and 2 with a depression 47 in handle 4 which conforms in shape and width to second portion 46 of locking member 38. Accordingly, locking member 38 pivots within depression 47 on pin 40 as described above and illustrated in FIGS. 1 and 2. An advantage of depression 47 is that means can be employed in combination with depression 47 for securely retaining within depression 47 second portion 46 of locking member 38. Suitable means include, for example, a ball and detent system or a narrowed portion within depression 47 which is not as wide as second portion 46 of locking member 38 so that second portion 46 will fit snugly therein.

Multi-functional screwdriver 2 of the present invention is used in the manner of conventional rotary hand tools to exert torque to a fastener. To use screwdriver 2, a workman selects and inserts one of the plurality of bits 14 into bit driver 34 where it is held in place by magnetic force. The bit is used to engage a fastener about which shaft 6 is rotated by applying rotary motion to handle 4. The offset of handle 4 allows the workman to use a cranking motion of his entire arm rather than of just his wrist, better utilizing the muscles of his shoulder and back as well as those of the upper arm.

When the fastener is nearly completely inserted into a work surface and tightening of the fastener desired, locking means 8 allows the workman to simply apply pressure to first portion 42 of locking member 38 so that it enters aperture 44 to prevent rotation of shaft 6. To disengage first portion 42 from aperture 44, the workman simply applies pressure to second portion 46.

As will be apparent to one skilled in the art, various modifications can be made within the scope of the aforesaid description. Such modifications being within the ability of one skilled in the art form a part of the present invention and are embraced by the appended claims.

It is claimed:

1. A multi-functional handtool comprising:

a handle, and a shaft forming a pair of coplanar bends, said pair of bends defining an upper section of said shaft, a lower section of said shaft and a middle section of said shaft, wherein said upper section of said shaft is rotatably mounted to said handle and said handle further comprises a locking means pivotally attached to said handle and adapted to be removably engaged with said shaft to effectively prevent rotation of said handle relative to said shaft.

2. A hand tool according to claim 1 wherein said locking means is a substantially L-shaped member.

3. A hand tool according to claim 2 wherein said locking means engages an aperture or a groove in said shaft.

4. A hand tool according to claim 1 wherein said locking means is pivotally attached to said handle by a pin.

5. A hand tool according to claim 1 further comprising a depression in the handle for receiving a portion of the locking means.

6. A hand tool according to claim 1 wherein said locking means engages said upper section at a point not contained within or covered by said handle.

7. A multi-functional hand tool comprising:

a handle having a compartment therein for storing a plurality of bits, a shaft forming a pair of coplanar bends, said pair of bends defining an upper section of said shaft, a lower section of said shaft and a middle section of said shaft, a non-conductive sleeve circumposed about said shaft, and a bit driver mounted to said lower section of said shaft wherein said upper section of said shaft is rotatably mounted to said handle and said handle further comprises a locking means pivotally attached to said handle and adapted to be removably engaged with said shaft to effectively prevent rotation of said handle relative to said shaft.

8. A hand tool according to claim 7 wherein said locking means is a substantially L-shaped member.

9. A hand tool according to claim 8 wherein said locking means engages an aperture or a groove in said shaft.

10. A hand tool according to claim 7 wherein said locking means is pivotally attached to said handle by a pin.

11. A hand tool according to claim 7 further comprising a depression in the handle for receiving a portion of the locking means.

12. A hand tool according to claim 7 wherein said locking means engages said upper section at a point not contained within or covered by said handle.

13. A multi-functional handtool comprising:

a handle having a resealable compartment therein for storing a plurality of bits, a magnetic shaft forming a pair of coplanar bends such that said shaft has a relaxed Z-shape, said pair of bends defining an upper section of said shaft, a lower section of said shaft and a middle section of said shaft, a non-conductive sleeve circumposed about an entire exposed length of said shaft, and a magnetic bit driver mounted to said lower section of said shaft wherein said upper section of said shaft is rotatably mounted to said handle and said handle further comprises a locking means pivotally attached to said handle and adapted to be removably engaged with said shaft to effectively prevent rotation of said handle relative to said shaft.

14. A hand tool according to claim 13 wherein said locking means is a substantially L-shaped member.

15. A hand tool according to claim 14 wherein said locking means engages an aperture or a groove in said shaft.

16. A hand tool according to claim 13 wherein said locking means is pivotally attached to said handle by a pin.

17. A hand tool according to claim 13 further comprising a depression in the handle for receiving a portion of the locking means.

18. A hand tool according to claim 13 wherein said locking means engages said upper section at a point not contained within or covered by said handle.

* * * * *